United States Patent [19]

Terada et al.

[11] 4,037,828

[45] July 26, 1977

[54] AUTOMATIC TAPPING MACHINE

[75] Inventors: Takashi Terada, Kurobe; Isamu Amemiya, Uozu; Shinsaku Kubota, Uozu; Koji Asada, Uozu, all of Japan

[73] Assignee: Nippon Carbide Kogyo Kabushiki Kaisha, Tokyo, Japan

[21] Appl. No.: 701,876

[22] Filed: July 1, 1976

[30] Foreign Application Priority Data

| | | |
|---|---|---|
| Oct. 4, 1975 | Japan | 50-119368 |
| Oct. 9, 1975 | Japan | 50-122106 |
| May 19, 1976 | Japan | 51-56641 |

[51] Int. Cl.[2] ..... C21B 7/12

[52] U.S. Cl. ..... 266/271

[58] Field of Search ..... 266/45, 271–273; 13/33

[56] References Cited

U.S. PATENT DOCUMENTS

| | | | |
|---|---|---|---|
| 439,924 | 11/1890 | Aiken | 266/271 |
| 2,535,932 | 12/1950 | Kemock | 266/271 |

*Primary Examiner*—Gerald A. Dost

[57] ABSTRACT

An automatic tapping machine for a tapping operation includes a movable truck; a lower frame rotatably mounted on the truck, an upper frame arranged always in parallel with the lower frame, and a pressure actuatable device for moving the upper frame towards, and away from the lower frame. A jig-supporting mechanism is adapted to hold a jig for use in the tapping operation, and a device is provided for supporting the jig-supporting mechanism above the frame and for actuating the jig-supporting mechanism as required in a tapping operation; the jig to be held in the jig-supporting mechanism has a diameter ranging from 40 mm to 100 mm.

13 Claims, 21 Drawing Figures

AUTOMATIC TAPPING MACHINE

The present invention relates to an automatic tapping machine for use in the tapping operation for an electric carbide furnace or an alloy making furnace.

At the beginning, the tapping operation for the furnace resorted exclusively to human labors but have gradually been mechanized as the operation is a dangerous operation performed by a high temperature and with heavy labors and in addition as a result of recent shortage of working power. However, there is some limit in the extent of such mechanization, and there are still left many aspects or steps which have to resort to human power. The major reasons are considered to come from the fact that, because of the excessive duration of life time of the furnace, the working site where the furnace was installed in the beginning is too narrow to be suitable for adoption of mechanization, namely, to provide the necessary operating facilities and that the tapping operation itself includes complicated steps. The larger becomes the size of the furnace, the more difficult is it to provide the operating facilities in the limited working space surrounding the existing furnace so as to mechanize the complicated working steps which have been accomplished so far by the human power.

The tapping machine now in use has a considerable overall size because its arm mechanism for supporting a variety of jigs for use in the tapping operation has a considerable length. Under the limited operating circumstances, the tapping machine of such large size is not desirable in its workability and mobility, as has been described in the above. Moreover, the tapping operation includes the step which requires flexible actions attainable only by the manual work and which is typically represented by the so-called "dreg removing" step. In the existing tapping machine, however, the upward and downward movements and the vertical rocking motions of the jig supporting arm mechanism are not satisfactory because of its structure. As a result, such step cannot be mechanized but has to rely upon the human operation.

Generally speaking, the tapping operation of an electric furnace is composed of: (1) the graphite applying step in which the tapping hole is melted by the use of an electric arc; (2) the tap opening and thrusting step, in which the molten tapping hole is thrusted and broken by a jig so as to allow the molten product such as carbide to flow out; (3) the trough cleaning step, in which the molten product adhered to the tapping trough as the result of its flow is removed therefrom; (4) the tap closing step, in which a clod of clay is filled to plug the tapping hole when the molten product has been completely discharged; and (5) the dreg removing step, in which the molten product having adhered to and solidified on the tapping trough after the plugging operation is removed. The cycle of a complete tapping operation continues 20 to 30 minutes. During this operation period it is necessary to interchange the jigs in accordance with the characteristics of the operation. Thus, the time duration required for interchanging the jigs during the tapping operation will determine the workability of the tapping machine, and accordingly its efficiency, further the value of itself.

Since, on the other hand, the tapping machine has its leading end exposed during the operation to the atmosphere having hit dusts, it will experience seizure and thermal damage due to the high temperature and malfunction of its sliding parts, with the result of frequent trouble and shortened life time.

In view of these points, the conventional tapping machine is of such an open type, in which a long jig is used in consideration of the thermal influences just in front of the tapping hole, and in which a jig mounting mechanism is disposed at a rear portion of the tapping machine located apart from the tapping hole. Thus, although there is no problem resulting from the thermal influences and the existing dusts, there is still left a serious problem coming from the use of a long jig, for instance, the problem in time duration and operational balance for interchange of the jigs with respect to a setting mechanism.

The tapping machine is usually made to run on rails and to thrust mechanically the tapping hole of a furnace by the use of a jig mounted to an arm which extends forward. Although the thrusting force required differs in the respective steps, the tapping machine has to be fixed to the rails so as to establish the thrusting force of a predetermined level. This is because the desired tapping operation cannot be accomplished if the machine is retracted by the reaction which is produced when it thrusts the tapping hole. Moreover, the tapping machine has its center of gravity positioned at a high level as a result of its structural requirement, and the center of gravity during the operation is considerably dislocated from the machine body because it has its arm extended forward and it is equipped with a jig. Thus, there is a danger in that the machine is raised to be derailed by the reaction which is built up when the tapping hole is thrusted. In the jig interchanging operation, moreover, there is another danger in that the machine may turn sideways due to loss of balance which is caused by the weight of the jig and by the shift of the center of gravity as the machine body is turned right and left. Therefore, it is greatly important to reliably fix the machine to the rails in every step.

It has been recently proposed that the force feedback system be adopted in the automatic tapping machine of that kind. This force feedback system aims at sensing the thrusting force, which is to be applied to the tapping hole by the tapping machine, by the use of a load cell or the like and at feeding back the sensed force to a jig control lever of the machine so as to allow the operator sense it as a reaction from the tapping hole. This system is remarkably useful in applying a predetermined thrusting force to the tapping machine and in exerting the influences of the characteristics of the respective steps to the operation of the tapping machine. Even with the force feedback system, the expected effects cannot be obtained unless the tapping machine is reliably fixed to the rails. This is because this system itself does not operate until the tapping machine senses correctly as a reaction the thrusting force which is imparted to the tapping hole. No matter how excellent the performance of the machine itself is, a satisfactory tapping operation cannot be expected unless that system accomplishes its desired operations.

The concept of fixing reliably the tapping machine to its rails is required not only for the inherent functions of the machine but also for the application of the force feedback system. However, there has never been proposed a satisfactory fixing mechanism.

The size of the tapping hole for the electric carbide furnace or the alloy making furnace has its limits in view of the flow rate of the molten product and the workability, and the jig such as the boring rod having the diameter of 20 to 25 mm is considered the best. The conventional size limitation has the following disadvantages:

a. The molten product will solidify, while flowing through the tapping hole, due to the temperature drop at the periphery of the tapping hole, and the effective area of this hole will be gradually reduced to obstruct the flow of the molten product. In order to promote the flow, it is inevitably required at all times for the operator to widen the tapping hole by the use of a jig.

b. The jig used will be hot-heated to become soft within a short time period to such an extent as cannot endure further use.

c. Moreover, the molten product will stick in a clod to the vicinity of the leading end of the jig to such an extent as cannot allow further operation. Thus, it is necessary to interchange jigs two or three times before the tapping operation is completed.

It is, therefore, an object of the present invention to provide an automatic tapping machine of a small size which can permit the complicated movements of a jig by improving the upward and downward movements and the vertical rocking motions of a jig supporting arm mechanism.

Another object of the present invention is to provide an automatic tapping machine of the type, in which a jig mounting mechanism is incorporated into a arm of sealed construction disposed at the leading end of the tapping machine.

Still another object of the present invention is to provide an automatic tapping machine which is equipped with a clamping mechanism for reliably fixing the tapping machine to rails.

A further object of the present invention is to provide a working method for accomplishing the tapping operation for a furnace by using a jig having a diameter from 40 to 100 mm with an automatic tapping machine.

A further object of the present invention is to provide a jig of special construction for use in the tap closing step of the tapping operation.

A primary feature of the present invention is that the jig supporting arm mechanism is of multiple step type. Thus, the space to be occupied by the supporting arm mechanism while the machine is not operated is minimized, which in turn reduces the size of the associated mechanism such as the arm mechanism supporting frame or the truck and accordingly the overall size of the machine. As will be understood from the foregoing discussion, the size reduction of the machine should be highly appreciated when taking the working circumstances surrounding the furnace of that type into consideration. In addition to the improvement in the workability, a tapping machine can be backed up when any trouble takes place in any one of the machine in use. More specifically, three machines are usually arranged around the furnace of that type, and it is possible to continue the operation of the furnace, even when any of the machine is damaged, by swiftly replacing it by another machine. According to the prior techniques, since a large machine is used under a restricted working circumstance, it is impossible to back up the damaged machine. Then, the operation of the furnace has to be interrupted unless it is accomplished by human power as in the conventional method.

A secondary feature of the present invention resides in the arrangement that the jig supporting arm mechanism can be not only moved up and down while keeping a horizontal position but also rocked vertically independently of the vertical movement. In the conventional tapping machine, arms are separately pivotted to front and rear portions of the jig supporting arm mechanism, and are actuated by separate hydraulic cylinders so that the height and inclination of the arm mechanism may be controlled simultaneously. Thus, it is difficult for the conventional tapping machine to move the jig in a complicated fashion. According to the present invention, however, the height and inclination of the arm mechanism are controlled independently of each other. More specifically, the forward and backward movements of the jig are suitably combined with the horizontal movements in a horizontal position and the rocking motions of the jig supporting arm mechanism, so that a flexible motions of the jig can be obtained for the tapping operation. Thus, it becomes possible to mechanize the step, which has relied upon the manual work, for example, the dreg removing step of the tapping operations.

Another feature of the present invention resides partly in that replacement of the jig can be accomplished reliably within a short time period because the jig mounting mechanism of the automatic tapping machine is used in cooperation with a jig holder of special construction which is mounted in advance to the rear end of the jig, and because the arm itself of the machine is made to chuck the jig and partly in that the machine can accomplish reliably the removal of the jig without being affected by the hot temperature and the existing dusts because the jig mounting mechanism is wholly incorporated into the arm of sealed construction which is mounted at the leading end of the machine.

A further feature of the present invention resides in that clamp members are arranged to clamp the rails so as to fix the tapping machine to the rails. As is different from the conventional method of simply pushing one side of the rail or of clamping the rail from the both sides, the present invention can fix reliably the tapping machine to the rails without any fear of derailment nor lateral turning, against any of the forces for retracting the tapping machine in parallel with the results, for floating the machine and for acting in the perpendicular direction to the rails. In this respect, the fixing method of the present invention is naturally desirable for the force feedback system. In the existing unreliable fixing method, moreover, there is a tendency for the operator to reluctantly operate the control lever or a fear that the facilities around the machine or the machine itself may be subject to damage, if the machine should be retracted by the reaction which is established when the tapping hole is thrusted. However, these disadvantages can be completely obviated by the clamping mechanism according to the present invention.

A further feature of the present invention resides in that a jig having a diameter from 40 to 100 mm is used in the tapping operation of an automatic tapping machine so as to prepare a tapping hole of a desired large diameter within a short time period and to minimize frequency of widening the tapping hole. According to this feature, the following advantages can be obtained:

1. Since the molten product flowing out of the tapping hole of a large diameter has a high heat capacity, the temperature drop around the tapping hole is so slow that contraction of the wall of the hole is reduced, thus minimizing frequency of repairment during the tapping operation.

2. Since the boring jig itself has a high heat capacity, the boring operation of the tapping hole and the repairing operation during the tapping operation can be finished within a short time period, thus hardly inviting the undesired hot heat.

3. Since the molten product on the jig solidifies in a thin layer, one cycle of the tapping operation can be accomplished with the use of a single jig without any replacement thereof.

BRIEF DESCRIPTION OF THE DRAWINGS

Other objects and advantages of the present invention will become apparent from the following description taken in conjunction with the accompanying drawings, in which:

FIGS. 17 to 21 are side elevations showing the relationships of the operation of the tapping machine according to the present invention with the furnace in the respective steps of the tapping operation, wherein FIG. 17 shows the graphite applying step, FIG. 18 the tap opening and thrusting step, FIG. 19 the trough cleaning step, FIG. 20 the tap closing step, and FIG. 21 the dreg removing step.

FIG. 1 is a typical tapping machine which has been used conventionally in the tapping operation of an electric furnace.

Figure 1:
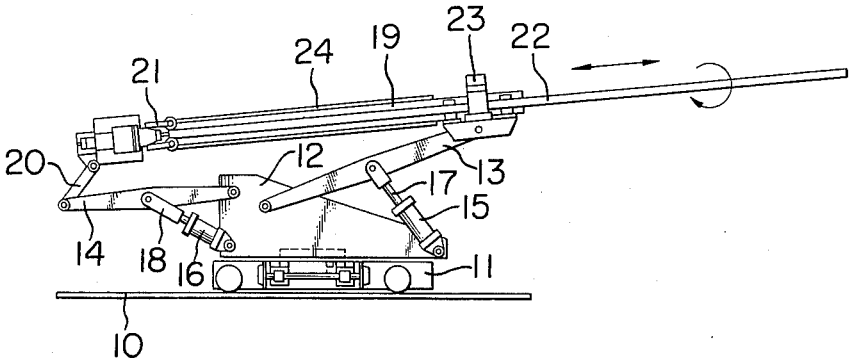
FIG. 1 is a side elevation of a conventional tapping machine.

The tapping machine has its base 12 placed rotatably upon a truck 11 which is made capable of running on rails 10 laid upon a working site. A front arm 13 and a rear arm 14 are pivotally mounted at their one end on each side of the base 12. A front hydraulic cylinder 15 and a rear hydraulic cylinder 16 are fixed at their one end to the front and rear arms 13 and 14, respectively. The piston rod 17 of the front hydraulic cylinder 15 has its one end connected pivotally to a center portion of the front arm 13, while the piston rod 18 of the rear hydraulic cylinder 16 has its one end connected pivotally to a center portion of the rear arm 14. The other end of the front arm 13 is connected pivotally to a front portion of a jig supporting arm mechanism 19, while the other end of the rear arm 14 is connected pivotally to a rear portion of the same mechanism 19 through a link 20. On a rear portion of the jig supporting arm mechanism 19, there is mounted a jig holding mechanism 21 which holes the rear end of a jig (or boring rod) 22. The jig 22 has its center portion supported loosely upon a support 23 which is disposed in front of the jig supporting arm mechanism 19.

The jig 22 can be moved back and forth within a slide frame 24 by the action of a sliding hydraulic cylinder (not-shown) which is mounted to a rear portion of the jig supporting arm mechanism 19.

In the tapping machine of this type, the jig supporting arm mechanism 19 is so elongated as to hold reliably the jig 22 having a considerable length. Since the jig especially for use in the thrusting step has as much length as 6 to 7 m, the length of the jig supporting arm mechanism is accordingly increased. This results in substantial increase in size of the front and rear arms 13 and 14 and further of the base 12, thus providing the overall machine structure of a considerable size. The arrangement of the tapping machine of such large size in a restricted area surrounding the electric furnace will of course deteriorate the workability and mobility of the machine.

In the tapping machine as shown, moreover, the vertical movement of the jig supporting arm mechanism 19 and accordingly of the jig 22 itself is accomplished by the actuation of the hydraulic cylinders 15 and 16, and the complicated operation such as the dreg removing step is accomplished by the combination of the back and forth movements of the jig with the vertical movement of the same resulting from the actuation of the hydraulic cylinders 15 and 16. It is, however, found difficult to control the two hydraulic cylinders 15 and 16 independently of each other and to control the height and the angles of depression and elevation of the jig at the same time so as to obtain such a flexible movement of the jig as could be effected by the manual operation of an operator. This is one of the causes which have made it difficult to mechanize wholly the tapping operation.

Figure 2:
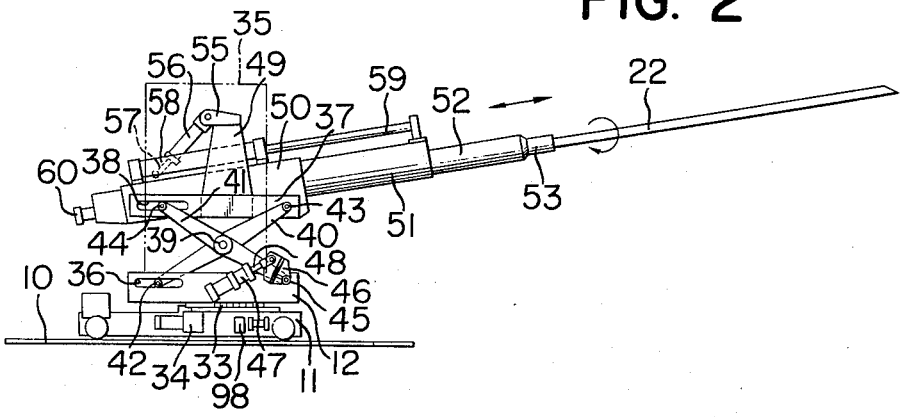
FIG. 2 is a side elevation of a tapping machine according to the present invention.
Figure 3:
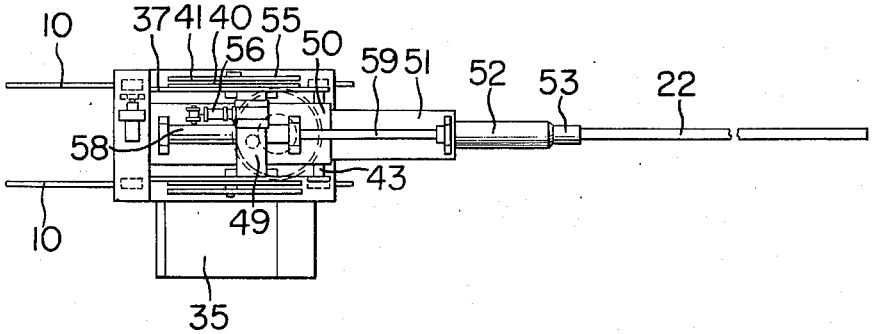
FIG. 3 is a top plan view of the tapping machine of FIG. 2.

Turning now to FIGS. 2 and 3, the tapping machine according to the present invention will be described. It should be noted that the same reference numerals appearing in the following drawings indicate the same parts or elements as those in FIG. 1.

In the tapping machine of the present invention, the base 12 is also placed upon the truck 11 which can run on the rails 10. A turning gear 33, which is fixed to the base 12, is driven for rotation by a turning mechanism 34 which is mounted on the truck 11 and which has such a gear as is in meshing engagement with the turning gear 33. To the truck 11 is attached an operator's stand 35 which is made to extend sideways therefrom (Reference should be made to FIG. 3). The base 12 is composed of two sheets of lower frames, which are made stationary in parallel with each other and each of which is formed at its rear portion with a longitudinal slot 36. Above the two lower frames 12, there are respectively arranged horizontal upper frames 37, each of which is formed at its rear portion with a longitudinal slot 38 having the same length as that of the slots 36. Each of the upper frames 37 is supported by a pair of links 40 and 41 which are pivotted at a shaft 39 to each other in an intersecting fashion. The link 40 has its lower end slidably received in the slot 36 of the lower frame 12 by the action of a pin 42 and its upper end pivotted to a front portion of the upper frame 37 by means of a pin 43. The other link 41 has its upper end slidably received in the slot 38 of the upper frame 37 by the action of a pin 44 and its lower end pivotted to a front portion of the lower frame 12 by means of a pin 45. An angle 46 is connected to the lower frame 12 by means of the pin 45 and is fixed to the link 41. To a center portion of the lower frame 12 is attached a lifting cylinder 47, the piston rod 48 of which has its leading end fixed to an upper portion of the angle 46.

Between another pair of the lower and upper frames 12 and 37, as will be understood, the same two links as the links 40 and 41 are pivotted to each other by means of the shaft 39. Here, it should be noted that, although the pins 42, 43 and 45 are made to extend between the two pairs of the lower and upper frames (The construction of the through pin 43 can be better seen from FIG. 5), the pin 44 does not extend between the two frame pairs but has engagement with the slot 38 of the respective upper frames.

The paired upper frames 37 and 37 are connected at their center portions to each other by means of a C-shaped frame 49. Within the frame 49 and between the upper frames 37 and 37, there is provided an outermost C-shaped first step arm 50 which is pivotted at its front portion to the upper frame 37 by means of the through pin 43. A second-step arm 51 is supported inside of the first-step arm 50 in a longitudinally slidable manner, as will be explained in detail with reference to FIGS. 4 and 5. A third-step arm 52 made of a cylindrical tube is also supported inside of the second-step 51 in a longitudinally slidable manner, as will be detailed later. To the leading end of the third-step arm 52 is fixed a jig holder 53, to which is mounted the jig 22. Thus, the first-, second- and third-step arms 50, 51 and 52 constitute the desired jig supporting arm mechanism.

A tilting cylinder 56 is made to have its one end pivotted to an angle 55 which is fixed to a head portion of the C-shaped frame 49. The tilting cylinder 56 is equipped with a piston rod 57 which has its one end pivotted to a rear top surface of the first-step arm 50. The tilting cylinder 56 thus constructed is made operative to rock the first-step arm 50 up and down about the through pin 43 so as to move the jig up and down. To an upper surface of the first-step arm 50, on the other hand, there is attached in parallel a relatively long cylinder 58 for the second step arm 51, the piston rod 59 of which has its leading end fixed to the front end of the second-step arm 51. To the inner wall of a rear portion of the second-step arm 51, there is attained a cylinder 60 which is made operative to move the first-step arm 52 back and forth, as will be described in more detail.

A rail clamping mechanism 98 is provided just above each of the rails 10 of the truck 11 of the tapping machine according to the present invention, so as to fix the tapping machine to the rails 10 during the tapping operation. The detail description of the rail clamping mechanism 98 will be made with reference to FIGS. 11 to 13.

The more detailed discussion will be made upon the jig supporting arm mechanism of the tapping machine of the present invention in connection with FIGS. 4 and 5.

Figure 4:
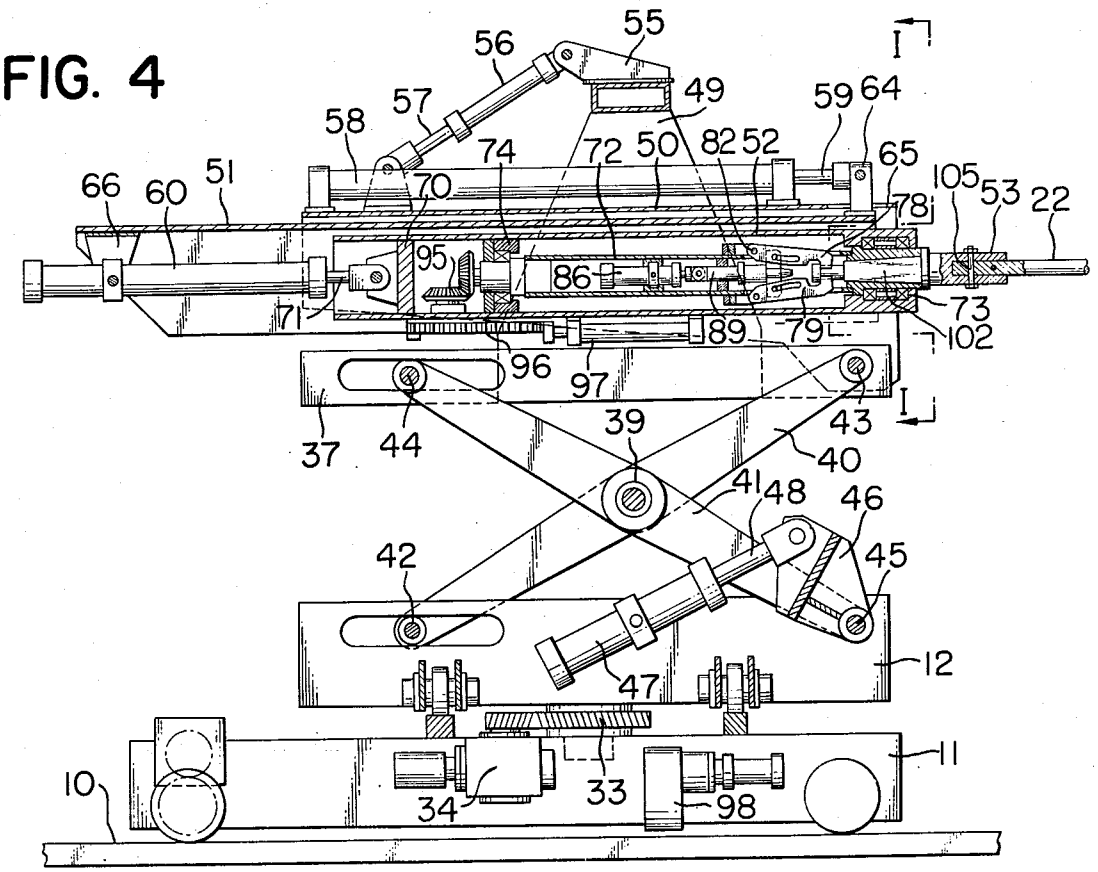
FIG. 4 is an enlarged side elevation showing in partial section an essential portion of the tapping machine of the present invention.

FIG. 4 is illustrated partially in section so as to show the jig supporting arm mechanism in detail.

The first-step arm 50 is made immovable in the forward and backward directions but is pivotted at its front sides to the upper frames 37 by means of the through pin 43. This first-step arm 50 is brought at its rear upper surface into rocking motion about the through pin 43 by the action of the piston rod 57 of the tilting cylinder 56, thus moving the jig 22 up and down.

Figure 5:
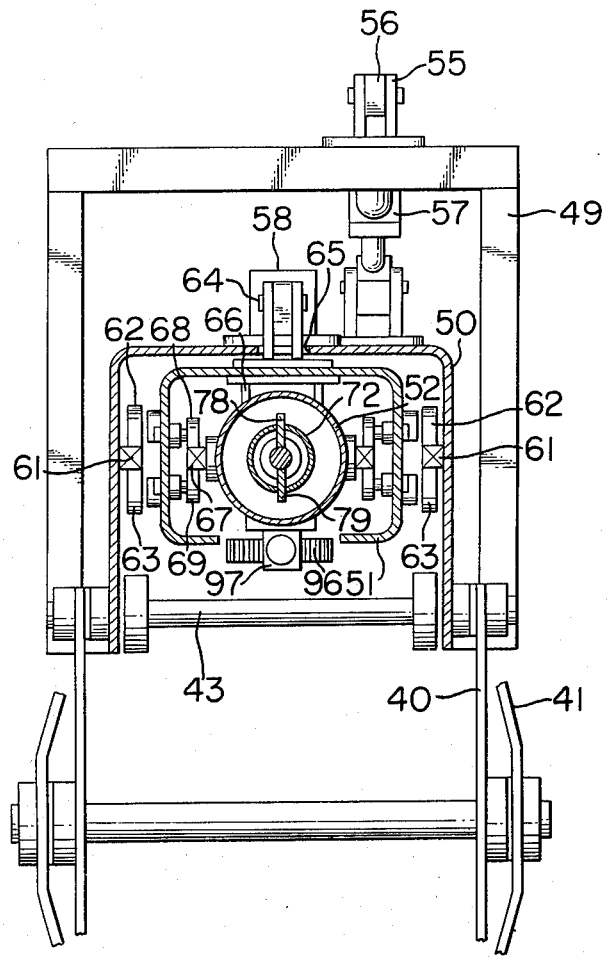
FIG. 5 is a further enlarged section taken along the line I — I of FIG. 4.
Figure 6:
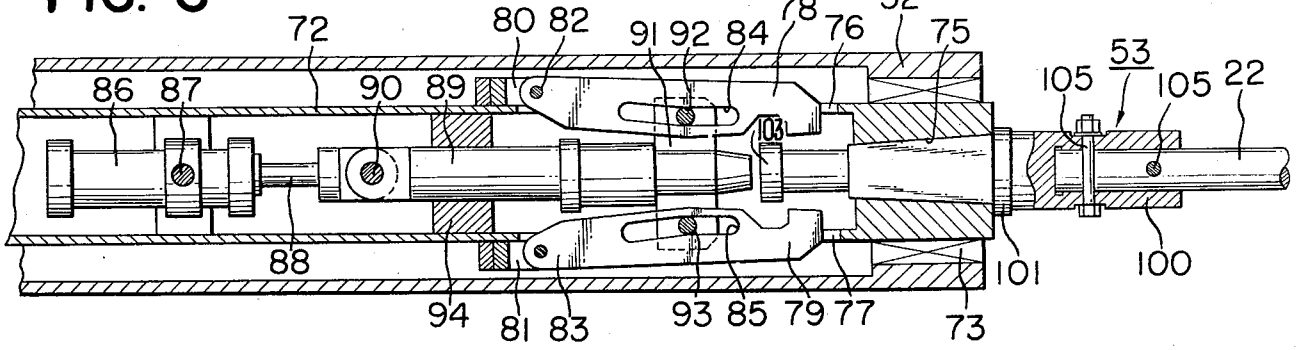
FIG. 6 is a longitudinal section showing the jig mounting mechanism according to the present invention under the condition before the jig is mounted thereto.
Figure 7:
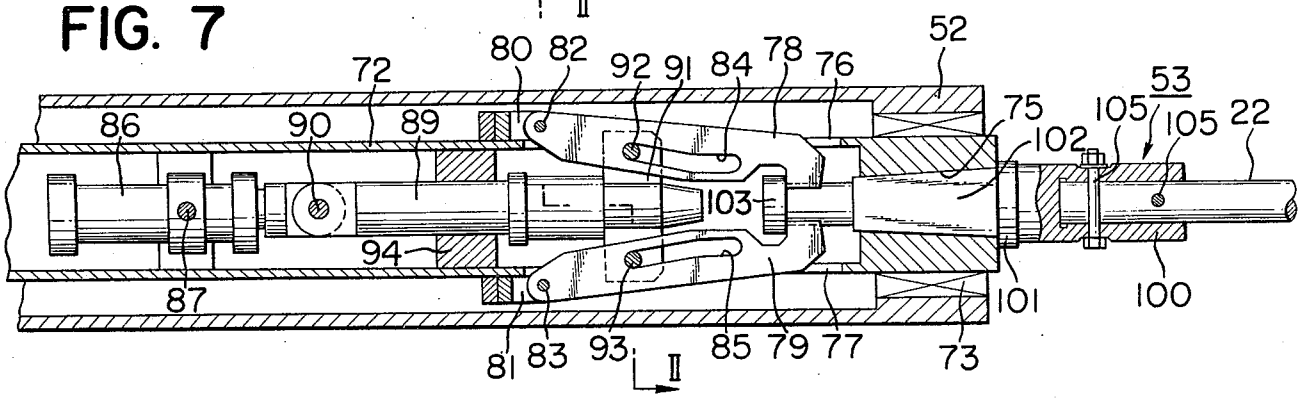
FIG. 7 is also a longitudinal section showing the jig mounting mechanism of the present invention under the condition after the jig is mounted thereto.

FIG. 5 is a front elevation showing a partial section of the jig supporting arm mechanism along the line I — I of FIG. 4. As will be apparent from FIG. 5, a pair of rails 61 and 61 are arranged on the both inside walls of the first-step arm 50 so that a plural pairs of upper and lower rollers 62 and 63, which are attached to the side walls of the second-step arm 51, may turn upon the upper and lower faces of the rails 61 and 61. The second-step arm 51 can move back and forth in that way. This second-step arm 51 is made to have its length slightly greater than that of the first-step arm 50 so that the leading end of the piston rod 59 of the second-step cylinder 58 may be fixed to the upper outer wall of the leading end of the second-step arm 51 by means of an upright post 64. As a result, the second-step arm 51 can move back and forth inside of the first-step arm 50 in response to the reciprocal motions of the piston rod 59. When the second-step arm 51 is moved to its most restracted position, the upright post 64 at its leading end enters the inside of a notch 65 which is formed in the upper surface of the leading end of the first-step arm 50. On the upper inside wall of the trailing end of the second-step arm 51, there is fixed a C-shaped support 66 which is made operative to support the rear portion of the third-step cylinder 60.

The third-step arm 52 is made of a cylindrical tube, to which are fixed a pair of rails 67 and 67 at the facing outer walls thereof. Each of these rails 67 is allowed to slide back and forth between a plural pairs of upper and lower rollers 68 and 69 which are mounted on the inner side walls of the second-step arm 51. To the inside of a rear portion of the third-step arm 52 is attached a disc 70, to which is fixed one end of the piston rod 71 of the third-step cylinder 60.

A jig mounting mechanism will now be described with reference to FIGS. 6 to 10. Within the third-step arm 52, as shown, there is provided a cylindrical sleeve 72 which is made to extend in the axial direction and which has its front end supported in a bearing 73 and its rear end born through a ring 74 fixed to the rear inside wall of the third-step arm 52. At the front end of the sleeve 72, there is formed a bore 75 of a rectangular shape, which is made to expand slightly in the forward direction. Inside of the arm 52 and in a front portion of the sleeve 72, moreover, there are formed a pair of upper and lower slots 76 and 77 which are arranged to face diametrically each other. Within the slots 76 and 77 are loosely fitted a pair of chucking claws 78 and 79, within have their rear ends supported by such pins 82 and 83 as are attached to flange tabs 80 and 81 fixed to the outer surface of the sleeve 72, respectively. These chucking claws 78 and 79 have their leading ends formed into a hook shape and their center portion formed with slots 84 and 85 which are made to extend longitudinally. These slots 84 and 85 are slightly bent at their respective center portions.

In a center portion of the sleeve 72, a hydraulic cylinder 86 is fixed by means of a side pin 87 and arranged in the axial direction, and a rod 89 is connected to the leading end of a piston 88 by means of a joint pin 90. To a front portion of the rod 89 is fixed a plate 91 which has a pair of claw connecting pins 92 and 93 in a parallel relationship in the vicinity of the upper and lower ends of the plate 91. These pins 92 and 93 are made to engage with the slots 84 and 85 of the chucking claws 78 and 79, respectively. The rod 89 is so supported as to slide back and forth by the action of a support ring 94 which is fixed in the sleeve 72.

The leading ends of the chucking claws 78 and 79 are opened and closed when the claw connecting pins 92 and 93 move in their slots 84 and 85 in the axial direction of the arm 52. Thus, the chucking claws 78 and 79 are opened, when the piston 88 of the hydraulic cylinder 86 extends, by the guidance of the claw connecting pins 92 and 93 which are anchored in the plate 91. These claw connecting pins 92 and 93 are so made as to move horizontally even after the chucking claws 78 and 79 are completely opened by the extension of the piston 88. The sleeve 72, which is accommodated in the arm 52 of closed construction, is made to have its front and rear ends rotatably born so that it may turn about the same axis by the command signal of its turning operation. Reverting to FIG. 4, at the rear end of the sleeve 72, there are provided a pair of bevel gears 95, which are driven by a gear mechanism 96 attached to the lower face of the third-step arm 52 so as to impart the rotation of the chucking claws 78 and 79 and accordingly to the gear 22. This gear mechanism 96 is driven by a jig turning cylinder 97.

Figure 10:
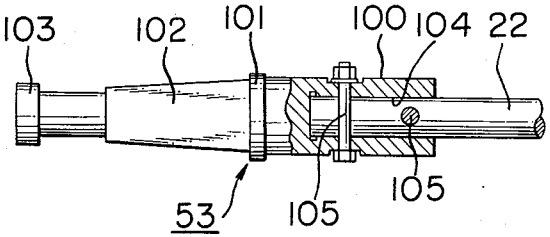
FIG. 10 is a side levation showing in partial section the jig holder which is used in cooperation with the jig mounting mechanism of the present invention.
Figure 8:
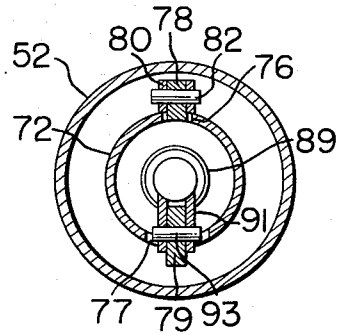
FIG. 8 is a transverse section taken along the line II — II of FIG. 7.
Figure 9:
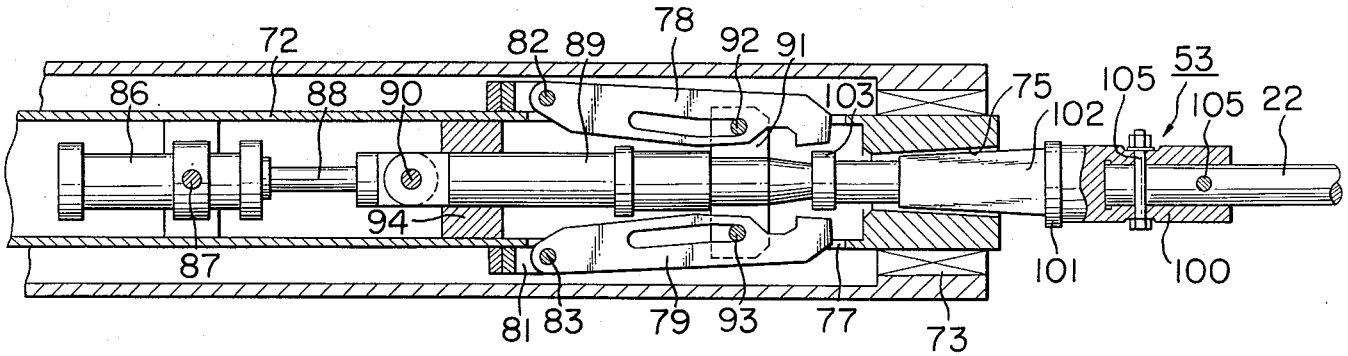
FIG. 9 is a longitudinal section showing the jig mounting mechanism of the present invention under the condition after the jig is removed therefrom.

In FIG. 10, there is shown a jig holder, which is used in coaction with the jig mounting mechanism thus far described and which is mounted in advance on the rear end of such various jigs as used in the respective steps of the tapping operation.

The jig holder 53 is generally of cylindrical shape and is composed, from its front end to its rear end, of a fastening portion 100 for mounting the jig 22 thereon, of a flanged portion 101 for bearing the pushing force, of a fixing portion 102, at which the jig holder 53 is fixed to the tapping machine, and a flanged end portion 103 for bearing the extracting force. At a center of the fastening portion 100, there is formed a jig holding bore 104, into which the rear end portion of the jig 22 is inserted so that it may be fixedly held by means of two orthogonal pins 105. The fixing portion 102 may be made to have a rectangular section and may be so tapered backwards that it may be easily attached to and removed from the tapping machine. This fixing portion 102 should not be limited to that having a rectangular shape but may be round if sufficient frictional engagement can be obtained between the bore 75 formed in the front end of the sleeve 72 and the fixing portion 102 itself.

Figure 11:
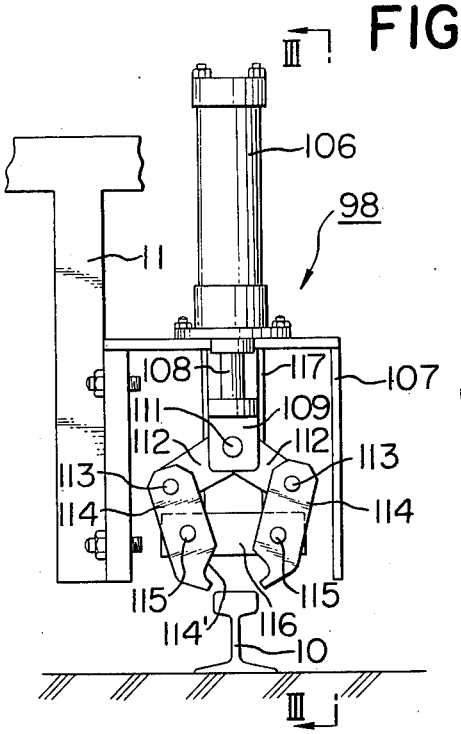
FIGS. 11 and 12 are partially cut-away front elevations showing the rail clamping mechanism according to the present invention, the former being under the condition before the rails are clamped, while the latter being under the condition after the rails are clamped.
Figure 12:
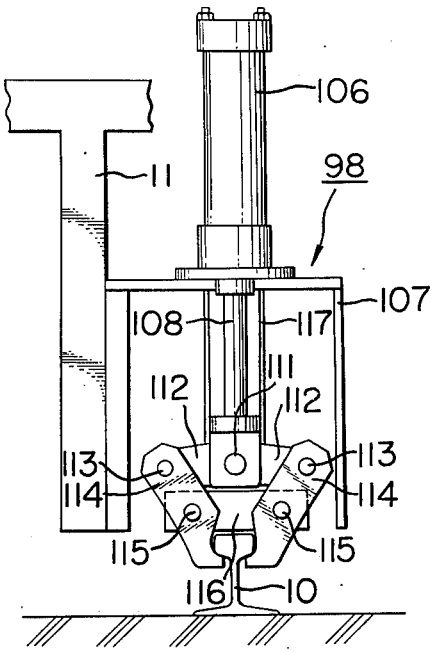
Figure 13:
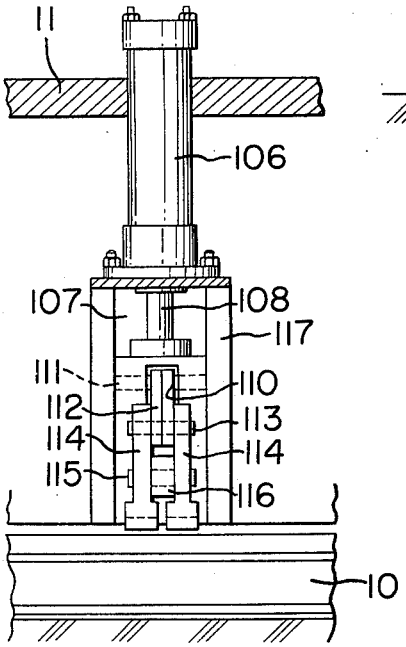
FIG. 13 is a section taken along the line III — III of FIG. 11.

Turning now to FIGS. 11 to 13, a rail clamping mechanism according to the present invention will be described as follows.

The rail clamping mechanism 98 is so mounted on the side of the truck 11 of the tapping machine as to be positioned just above each of the rails 10. A hydraulic cylinder 106 for driving the rail clamping mechanism 98 is fastened to an upper portion of a frame 107 by means of bolts. To the leading end of the piston 108 of the hydraulic cylinder 106 is fixed a metal fitting 109 which is formed at its center with a groove 110 (Reference should be made to FIG. 13). Two link plates 112 and 112 are pivotally mounted to the inside of the groove 110 at their one end by means of a pin 111. A clamp plate 114 is pivotted to the other end of each of the link plates 112 by means of a pin 113. The paired clamp plates 114 and 114 are pivotally connected by a link plate 116 at pins 115 and 115, respectively. The metal fitting 109 is made to engage with and guided by a U-shaped guide frame 117 when it moves up and down together with the piston 108.

Each of the clamp plates 114 is formed, as is apparent from FIG. 11, at its lower portion with a hook portion 114' which has substantially the same shape as that of the head contour of each of the rails 10. The lower portions of the clamp plates 114 are so widened as to clamp the rails reliably, as can be seen from FIG. 13.

Figure 14:
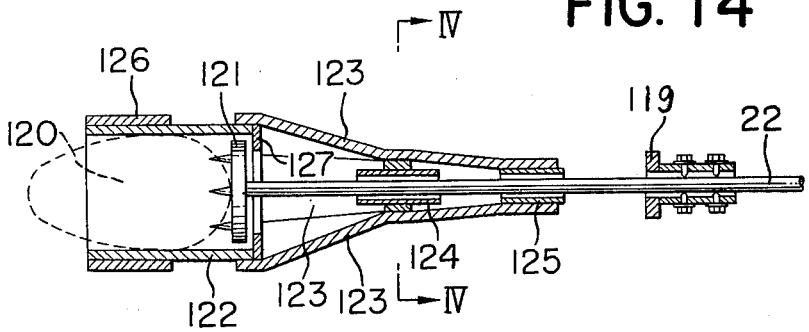
FIG. 14 is a side elevation showing a jig for use in the tap closing step of the tapping operation.
Figure 15:
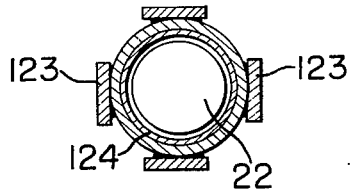
FIG. 15 is a section of the jig taken along the line IV —IV of FIG. 14.

FIGS. 14 and 15 show the jig to be used in the tap closing step of the tapping operation.

In the tap closing, step, a clod of clay 120 is fitted into the tap of the furnace so as to plug the tap up. The clod of clay 120 is applied by the use of suitable means such as a pin to a flat plate 121 which is attached to the leading end of the jig 22. The leading end of the jig 22 is enclosed by a cylindrical protecting tube 122 so as to protect the clod of clay 120. To the rear portion of the protecting tube 122 are welded four split support legs 123 which are divided circumferentially and which are extending in the axial direction. These four support legs 123 are equipped in its inside with guide sleeves 124 and 125 which allow the legs to be supported in a loose manner relative to the jig 22. Two split rings 126 are mounted on the outer periphery of the protecting tube 122 so as to prevent the tube 122 from being heated by the high temperature at the tap of the furnace to such an extent as to be deformed. The protecting tube 122 is formed at its rear end with an inward flange portion 127 so that the flat plate 121 at the leading end may not come out of position from the protecting tube 122.

When, in the tap closing step, the clod of clay 120 on the flat plate 121 arrives at the tap and the jig 22 is further pushed, then the protecting tube 122 is stopped at the wall of the tap but the clay 120 itself can be further forwarded together with the jig 22. In this meanswhile, the protecting tube 122 moved relatively backward with respect to the jig 22 until it abuts against a jig stopper 127 attached thereto at the back of the support legs 123, as the legs 123 slide on the jig 22 through their guide sleeve 124. Since the support legs 123 are split, it is possible to remove the molten product of the furnace even if the product steals into the inside the protecting tube 122 or among the support legs 123 after the clad filling operation or upon the failure of the operation.

Figure 16:
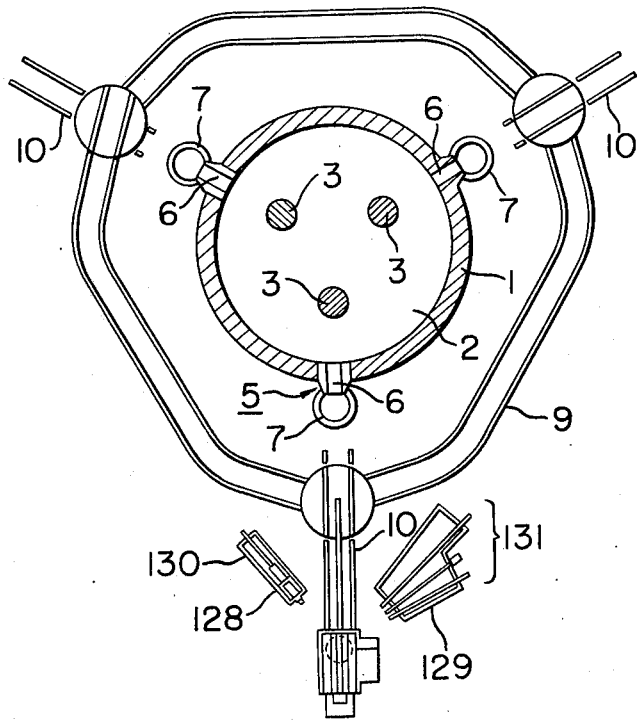
FIG. 16 is a view showing the arrangement of the tapping machine according to the present invention.

Reference will now be made to FIG. 16 which shows the arrangement around an electric furnace. The electric furnace 1 is charged with a material 2 to be melted, and electrodes 3 are then inserted into the furnace to melt the material. The resultant molten product 4 is allowed to flow out through tapping trough 6, after the tapping hole 5 is broken, so that it may be poured into ladles 7 (The molten product 4 and the tapping holes 5 will be discussed in more detail in connection with FIGS. 17 and 21). Around the electric furnace 1, there are placed a pair of rails 9 for effecting shifting of the tapping machine, in addition to the rails 10 which are positioned to face the respective tapping holes 5. One tapping machine is arranged for every tapping hole (but only one is shown in FIG. 16 for simplicity of discussion). At the both sides of the rails 10, there are provided jig tables 128 and 129 so that a jig 130 for the graphite applying step may be placed upon the former table 128 and that another jig 131 for the remaining steps may be placed upon the latter table 129.

Figure 17:
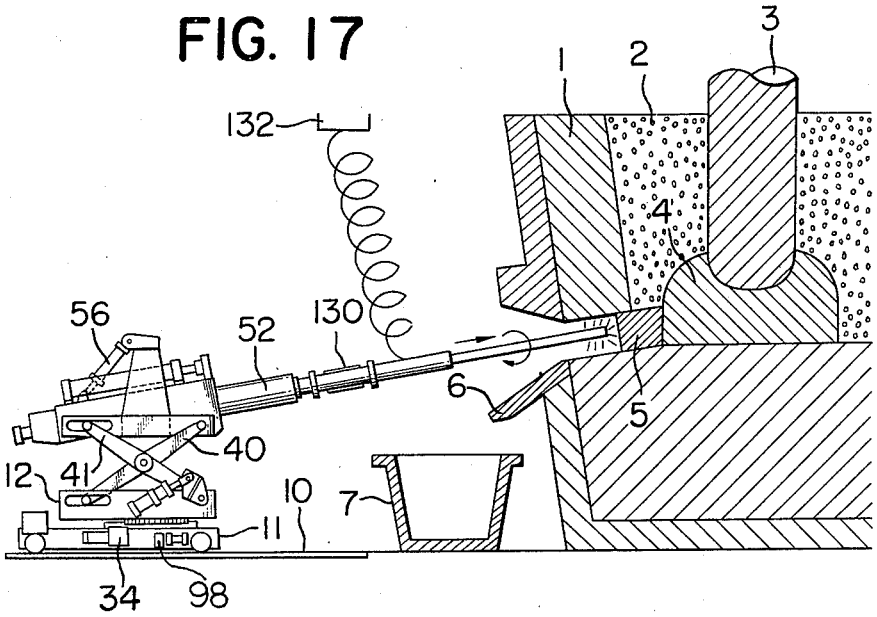

The operations of the respective steps of the tapping machine according to the present invention will now be explained with reference to FIGS. 17 and 21 for the case of a carbide furnace.

When it is intended to accomplish the graphite applying step, the tapping machine is so positioned as to point to the center of the electrodes 3, and the operator on the stand 35 tried to command the tapping machine to turn leftward by manually operating a control lever which adopts the force feedback system. Then, the turning mechanism 34 is actuated such that the base 12 is turned on the truck 11 through the turning gear 33 until the jig supporting arm mechanism (including the first-, second- and third-step arm 50, 51 and 52) supported on the upper frame 37 is directed to point to the jig 130 for the graphite applying step on the jig table 128. In this instance, the rectangular bore 75 formed at the leading end of the sleeve 72 of the third-step arm 52 is arranged in phase with the holding portion of the jig holder 53 which has been mounted in advance to the rear end of the jig 130 for the graphite applying step. When, under this condition, the operator pushes the operating lever on the control panel in the tapping machine down to the clamp side, then the hydraulic cylinder 106 is actuated to extend its piston 108 so that the lower face of the link plate 116 may be brought into abutment engagement with the head surfaces of the rails 10. When the piston 108 extends more and more, the paired link plates 112 and 112 are gradually widened about the pin 111. As this condition proceeds, the paired clamp plates 114 and 114 are also turned about the pin 115 so that their hook portions 114' may clamp the head portions of the rails 10 so as to fix the machine to the rails 10. The rail clamping mechanism 98 thus constructed can clamp reliably the rails 10 because two clamp plates 114 are provided on each of the rails and because their hook portions 114' are made considerably wider.

Then, the tilting angle of the third-step arm 52, which is built in the first-step arm 50, is adjusted for the graphite applying step jig 130 by the extension of the tilting cylinder 56, which is controlled by the control lever in view of the condition of the jig supporting arm mechanism. At the same time, the links 40 and 41 are actuated by the lifting cylinder 47 so as to adjust the level of the tapping machine. Next, the second-step cylinder 58 is extended to thrust the second-step arm 51 until the flanged end portion 103 of the jig holder 53 comes close to the leading end of the sleeve 72 and until the fixing portion 102 is inserted closely into the bore 75 (as will be seen from FIG. 6). After that, the piston 88 of the hydraulic cylinder 86 is so extracted that the claw connecting pins 92 and 93 may slide backward through the rod 89 to close the chucking claws 78 and 79 (as will be seen from FIG. 7). In these ways, the jig holder 53 and accordingly the graphite applying step jig 130 are mounted to the tapping machine of the present invention. The jig supporting arm mechanism in a tilted condition is then returned to a horizontal position by the actuation of the tilting cylinder 56, and the base 12 is turned rightward by use of the turning mechanism 34 until it is directed to point to the center of the electrodes 3, thus finishing the mounting operation of the graphite applying step jig 130. When the operation lever is pushed down to the unclamp side by the operator after the mounting operation, the piston 108 of the hydraulic cylinder 106 is extracted and the clamp plates 114 and 114 are opened to unclamp the rails 10.

Then, the truck 11 is moved forward toward the furnace 1 and is halted in a predetermined front position. Then, the rail clamping mechanism 98 is actuated again to fix the tapping machine on the rails 10. The second-step arm 51 is thrusted forward, while the position of the leading end of the graphite applying step jig 130 is being observed, by the action of the second-step cylinder 58 until it approaches to the tapping hole 5, as shown in FIG. 17. Thus, the jig 130 is so adjusted in its height and inclination as to have its leading end point to a predetermined hole position by the actuation of the cylinders. Here, the graphite applying step jig 130 is energized by a power supply device 132 to establish arcs between its leading end and the tapping hole 5 so that the solid carbide layer around the tapping hole 5 may be reformed and melted immediately before it is broken. After this graphite applying step is completed, the third-step arm 52 holding the jig 130 is retracted together with the second-step arm 51.

In order to remove the jig from the tapping machine after completion of the graphite applying step, the rail clamping mechanism 98 is unclamped, and the truck 11 is retracted and then turned in a predetermined rear position until the tapping machine comes to its correctly pointing position with the jig table being located in a predetermined position. Then, the piston 88 of the hydraulic cylinder 86 is so extended that the rod 89 may extend forward (or rightwardly in FIG. 9) through the joint pin 90. As a result, the chucking claws 78 and 79 are opened by the forward horizontal movements of the claw connecting pins 92 and 93 which are studded in the plate 91. When the hydraulic cylinder 86 is actuated to further extend the piston 88 forward, the leading end of the rod 89 pushes the flanged end portion 103 of the jig holder 53 with the chucking claws 78 and 79 being left open (Reference should be made to FIG. 9). In this way, the slight pushing action can loosen the fixing portion 102 of the jig holder 53 from the bore 75, thus making it possible to remove the same from the leading end of the sleeve 72. If, in this instance, the arm 52 is retracted, the jig holder 53 and accordingly the graphite applying step jig 130 can be removed from the tapping machine.

Figure 18:
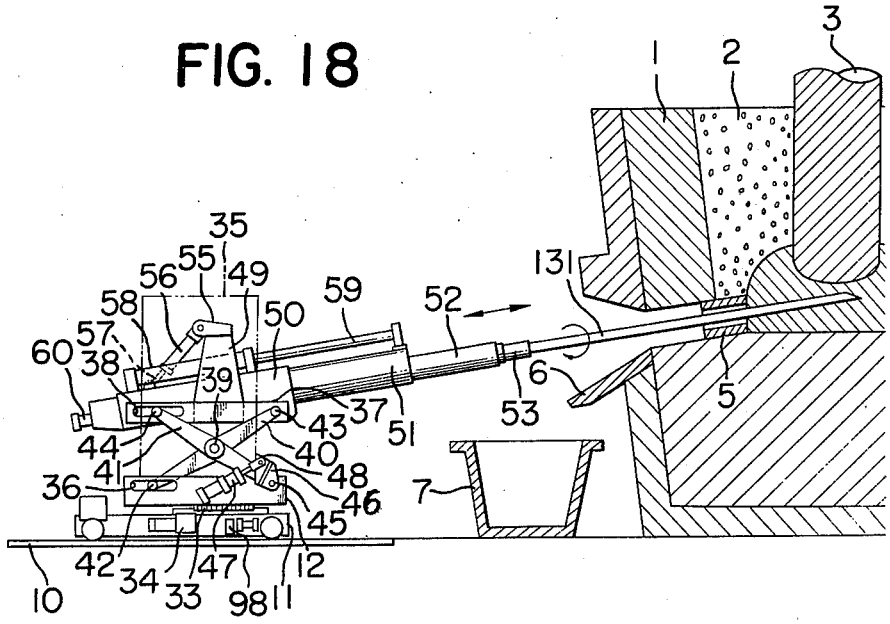

When it is intended to accomplish the tap opening and thrusting step, the tapping machine is turned rightward of FIG. 16 in the predetermined rear position, and the jig (or the boring rod) on the jig table 129 is chucked by the jig holding mechanism in the same manner as described in the above. The tapping machine is then returned to its original position and advanced to be stopped in the predetermined front position, in which the rail clamping mechanism 98 is actuated to fix the truck 11 to the rails 10. As shown in FIG. 18, the third-step arm 52 is extended by the action of the third-step cylinder 60 so that the leading end of the jig 131 may be so adjusted in its inclination and level as to point at the tapping hole 5 which has been subjected to reform in the previous step. Then, the second-step arm 51 is extended by the second-step cylinder 58 to break the tapping hole 5 so as to allow the molten carbide 4 to flow out. If this flow is insufficient, the jig 131 is thrusted into the center of the electrode 3 so as to promote the flow of the molten carbide 4. The flow of the carbide 4 thus increased is then received by the ladle 7. The ladle 7 is moved away and replaced by a stand-by ladle when it is filled with the carbide 4. In this way, the thrusting step is finished.

Figure 19:
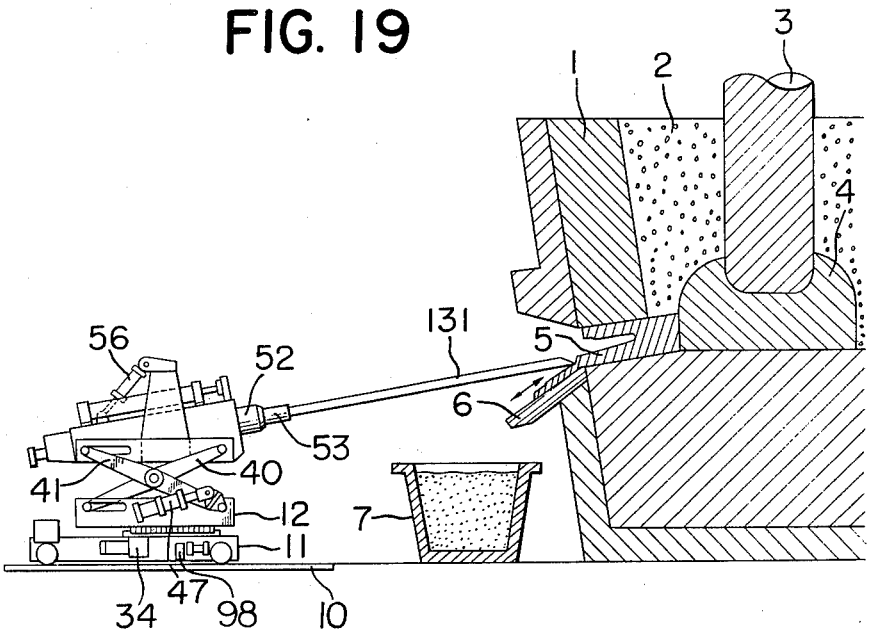

FIG. 19 shows the condition of the tapping machine in the trough cleaning step. The jig is left what it is in the previous tap opening and thrusting step, and the third-step arm 52 is retracted. Then, the carbide which has sticked to and solidified on the tapping trough 6 is removed by the combined back and forth movements of the second-step arm 51 resulting from the tilting cylinder 56. In this meanwhile, the upper frame 37 of the machine is left in its lowermost position.

Figure 20:
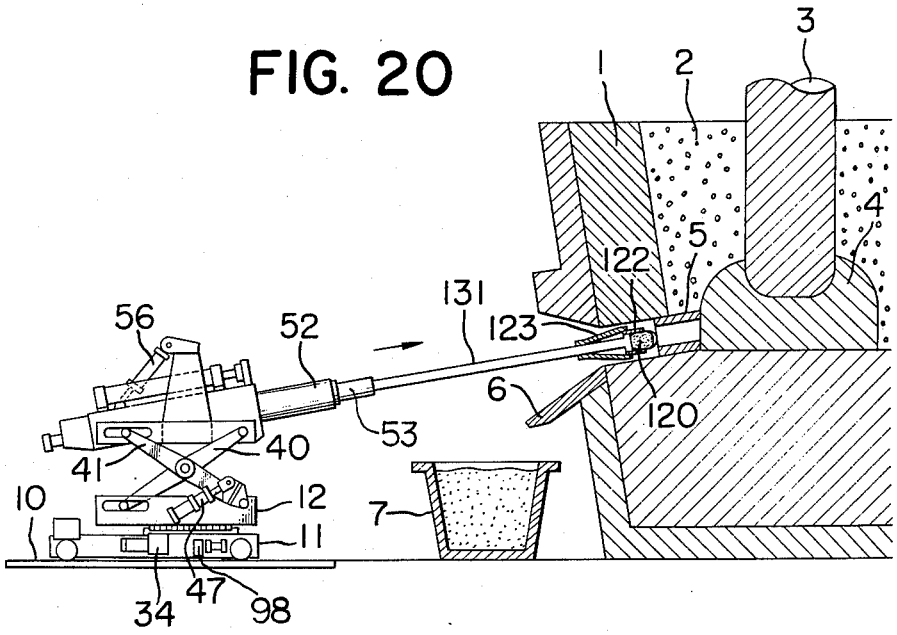

FIG. 20 shows the condition of the tapping machine in its tap closing step.

Prior to this tap closing step, provision is made of a jig 131 which has the clod of clay 120 at its leading end for closing the tapping hole 5. The removal of the jig used in the previous step and the mounting of the jig to be used in the tap closing step are absolutely the same as those of the previous step, and as such being the case, their repeated explanation is omitted here. For the actual operation, after the taping machine is fixed at the predetermined front position by the rail clamping mechanism 98, the second-step arm 51 is extracted while the third-step arm 52 is left unextracted. The machine is then positioned to point to the tapping hole 5, and the cod of clay 120 at the leading end of the jig 131 is thrusted into the hole 5 for the closing purpose. In this instance, it should be noted that there is no fear of any deformation and drop of the clod of clay 120, which might otherwise take place when it hits the wall of the tapping hole 5. This is because the clod of clay 120 is carried to the tapping hole 5 while being protected by the tube 122. When the clod of clay 120 is suitably applied into the tapping hole 5, the protecting tube 122 is retracted along the jig 131 until it abuts against the jig stopper 127. The deformation of the leading end of the jig due to read heat can also be prevented by the protecting tube 122. If the trapping hole 5 fails to be plugged with the clod of clay 120 or if the carbide flows into the space among the support legs 123 after the plugging operation, the clay or the carbide can be easily removed from that space. During the tap closing step, the upper frame 37 is in an elevated position from the base 12. After the clod of clay 120 is left in the pushed condition for several minutes, the jig is retracted. Then, the clod of clay 120 is left what it is in the tapping hole, thus finishing the plugging operation of the tapping hole.

Figure 21:
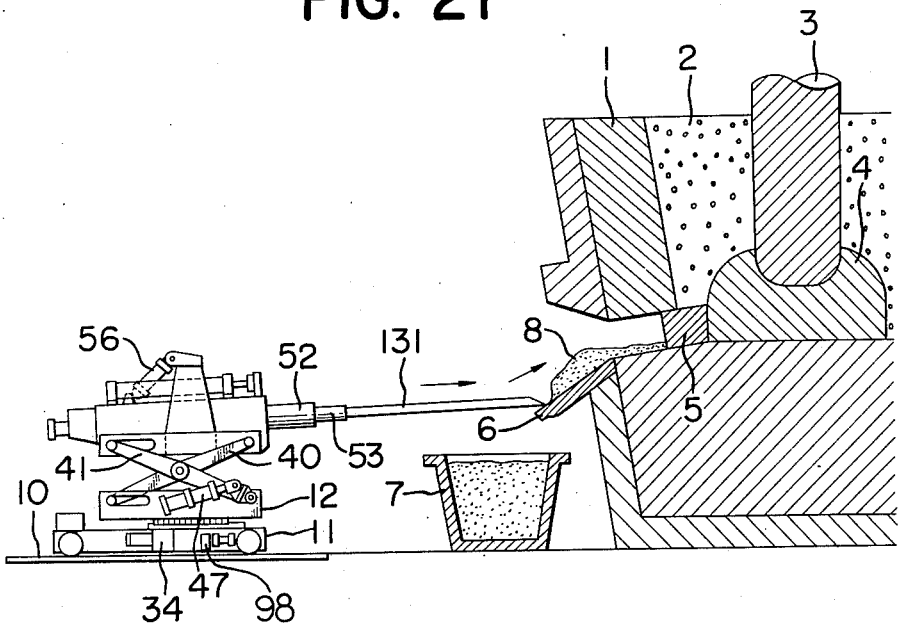

FIG. 21 shows the condition of the tapping machine in the dreg removing step.

Reverting to FIG. 16, the tapping machine is turned rightward in the predetermined rear position, and the jig (or the boring rod) on the jig table 129 is chucked. Then, the machine is turned leftward until it points at the center of the electrode 3. After this, the truck 11 is advanced toward the electric furnace 1. The truck 11 is stopped when the foremost end of the jig (or the boring rod) 131 comes to the front end of the tapping trough 6 at the side of the ladle 7. Then, the rail clamping mechanism 98 is actuated to fix the truck 11 to the rails 10. The links 40 and 41 are then actuated by the extension of the lifting cylinder 47 so that the upper frame 37 may be lowered to its lowermost limit. The carbide adhered to the tapping rough 6 progressively turned on and on toward the inside of the tapping hole 5 by the smoothed protruding and rocking movements of the jig (or the boring rod) 131 composed of the vertical movements of the jig 131, which is effected about the through pin 43 by the actuation of the tilting cylinder 56, and of the back and forth movements of the second-arm 51 which is effected by the actuation of the second-step cylinder 58. When the second-step cylinder 58 is extended to its full stroke, the dreg removing step is similarly repeated to the method as described in the above, partly by contracting the second-step arm 51 with the use of the second-step cylinder 58, partly by extracting the third-step arm 52 with the use of the third-step cylinder 60 and partly by actuating the links 40 and 41 with the use of the lifting cylinder 47 so as to adjust the height of the upper frame 37. After this dreg removing step, the third- and second-step arms 52 and 51 are contracted, and the rail clamping mechanism 98 is released to move the truck 11 backward. At the predetermined rear position, the jig 131 is received into the jig table 129 by the dismounting operation, and the base 12 is turned leftward to point at the tapping trough 6, thus finishing the dreg removing step.

Since, in the tapping machine of the present invention, the jig supporting arm mechanism is of such a multiple step type that is can be moved up and down in its horizontal position and can be rocked up and down independently of the vertical movement, it should be appreciated that the overall size of the tapping machine can be reduced to a considerable extent and that such flexibility as comes from manual operations can be obtained. Even at a restricted working site surrounding the furnace, therefore, workability and mobility are so increased not only in the tapping operation but also in the replacing operation of the jig that the operation requiring for complicated actions can be mechanized without resorting to manual actions. Thanks to such compactness, moveover, even when any of the three machines gets out of order with the rails 9 being laid as shown in FIG. 16, another machine can run on the rails 9 to back up the broken machine in a simple and swift manner. Thus, provision of two machines can continue the tapping operation. For the conventional machine of a large size, however, this advantage cannot be expected as a result of the restriction in the working area even if the rails 9 are made to run in the same manner.

According to the present invention, moreover, it should be appreciated that the tapping machine is hardly influenced by the heat from the furnace and by the dusts and accordingly that no trouble takes place since the jig mounting mechanism in incorporating into the inside of the arm of a closed construction. Since the fitting portions between the tapping machine and the jig holder are tapered and since the rear end of the jig holder is forced out upon the releasing operation of the jig, no difficulty in the releasing operation is experienced, which might otherwise be caused by the thermal expansion. These advantages can be obtained not only in the above case where the mounting mechanism according to the present invention is used in the tapping machine for the furnace tapping operation, but also in the case where the same mechanism is used in the atmosphere at a high temperature and with dusts. Thus, the present invention finds a wide variety of applications.

Since, moreover, the rail clamping mechanism of the present invention is made such that the rail clamping portion of the hook plate is shaped into the hook portion, the head portion of the rails can be clamped in a manner to be grasped not only sideways but also upwardly. Thus, it is possible to obviate completely such a danger as may float and derail the tapping machine due to the reaction which is established in the tapping operation.

The present invention is not limited to the embodiment so far disclosed but can be applied to any system if the rails are clamped by pressure actuatable means. In place of the paired movable clamp members of the embodiment, for example, the combination of a movable clamp member and a stationary clamp member can be used. The rail clamping mechanism according to the present invention is advantageous in that its clamping force can be increased by selecting a large level for the pressure of the pressure actuatable means. In the case, however, where the reaction to be received from the tapping hole due to excessiveness in the clamping force between the tapping machine and the rails is so imparted to a mechanically weak portion of the machine body that an unexpected damage may take place, the pressure of the pressure actuatable means is preset at a proper level such that, for the reaction higher than a predetermined level, the machine is intentionally slipped relative to the rails to obviated such damage.

The reason why the jig to be used in the tapping machine of the present invention is made to have a diameter larger than 40 mm is that the diameter smaller than that level is practically insufficient for achieving the inherent effects of the jig. On the other hand, the reason why the jig is made to have a diameter smaller than 100 mm is that the diameter larger than that level will increase the weight to such an extent that it is inconvenient to handle the jig and that it is impossible to expect those effects. Thanks to the combination of the jig having a large diameter and the tapping machine, as has been described hereinbefore, the present invention can simplify the tapping machines which have been considered such an operation as is dangerous at a high temperature and as requires high skills.

What we claim is:

1. An automatic tapping machine for a tapping operation comprising a movable truck, a lower frame rotatably mounted on said truck, an upper frame arranged always in parallel with said lower frame, pressure actuatable means for moving said upper frame towards and away from said lower frame, a jig supporting mechanism adapted to hold a jig for use in the tapping operation, and a means for supporting said jig supporting mechanism above said frame and for actuating said jig supporting mechanism as required in the tapping operation, said jig holdable in said jig supporting mechanism having a diameter ranging from 40 to 100 mm.

2. An automatic tapping machine for tapping operation comprising a movable truck; a lower frame rotatably mounted on said truck; an upper frame arranged always in parallel with said lower frame; pressure actuatable means for moving said upper frame towards and away from said lower frame; a jig supporting arm mechanism including at least two arms which are made movable in the longitudinal direction relative to each other, one of said arms being pivotted to said upper frame while the other arm being adapted to hold at its leading end a jig for the tapping operation; and pressure actuatable means for vertically tilting said jig supporting arm mechanism at the pivot relative to said upper frame, each of said arms of said jib supporting arm mechanism having a pressure actuatable means provided for moveing the adjacent arm in its longitudinal direction.

3. An automatic tapping machine as claimed in claim 2 wherein said truck is made movable on rails.

4. An automatic tapping machine as claimed in claim 2 wherein on said other arm there is provided a jig mounting means for mounting and dismounting the jig to and from said tapping machine through a jig holder comprising a jig mounting bore at its front portion, a tapered fixing portion at its center portion and a flanged portion at its trailing end; wherein a sleeve having a tapered bore formed at its front end portion for receiving the fixing portion of said jig holder, is arranged in the inside of the arm of closed type in a manner to extend in the axial direction; wherein a pressure actuatable cylinder is disposed in said sleeve; wherein at least two pins are studded on the rod connecting to the piston of said cylinder at a spacing from each other in the perpendicular relationship to the longitudinal direction of said sleeve; wherein at least two slots are formed in a front portion of said sleeve, wherein a jig holder chucking claw, which has its one end pivotted to said sleeve at the rear portion of each of said slots, is loosely fitted in the last-mentioned slot; wherein at a center of said chucking claw there is formed a slot which has at least its portion inclined at an angle with respect to the longitudinal direction of said sleeve; wherein each of said chucking claws has its leading end formed into a hook portion for holding the flanged portion of said jig holder during the mounting operation of the jig; and wherein each of the pins of said rod is made to engage in each of the slots of said chucking claws.

5. An automatic tapping machine as claimed in claim 4 wherein said sleeve is made rotatable relative to said other arm.

6. An automatic tapping machine as claimed in claim 5 wherein the tapered bores formed in the fixing portion of said jig holder and in the leading end portion of said sleeve are shaped rectangular.

7. An automatic tapping machine as claimed in claim 3, further comprising rail clamping means disposed on said truck just above said rails for fixing said tapping machine to said rails during the tapping operation.

8. An automatic tapping machine as claimed in claim 7 wherein said rail clamping means includes pressure actuatable means arranged on said truck, and clamp members adapted to be opened and closed by said pressure actuatable means so as to clamp said rails.

9. An automatic tapping machine as claimed in claim 8, wherein the force feedback system is adopted.

10. An automatic tapping machine as claimed in claim 7 wherein said rail clamping means is adapted to allow said tapping machine to slide on said rails so as to obviate the damage which might otherwise be given to said tapping machine, when a reaction greater than a predetermined level is applied to said tapping machine.

11. An automatic tapping machine as claimed in claim 2 wherein said jig supporting arm mechanism includes a first step arm pivotted at its front portion to said upper frame, a second step arm arranged slidably inside said first step arm, and a third step arm arranged slidably inside said second step arm and wherein said jig mounting means is mounted on said third step arm.

12. An automatic tapping machine as claimed in claim 2 wherein the jig has a diameter ranging from 40 to 100 mm.

13. An automatic tapping machine as claimed in claim 2 wherein the jig for the tap closing operation includes a cylindrical protecting tube at its leading end, support legs secured to said protecting tube and made slidable in the axial direction along said jig, and a jig stopper fixed thereto in a position apart from said support legs.

* * * * *